US005312262A

United States Patent [19]

Bublitz

[11] Patent Number: 5,312,262

[45] Date of Patent: May 17, 1994

[54] DECOUPLING TOOL MECHANISM FOR ELECTRICAL CONNECTORS

[75] Inventor: Jeff L. Bublitz, Satellite Beach, Fla.

[73] Assignee: Harris Corporation, Melbourne, Fla.

[21] Appl. No.: 995,442

[22] Filed: Dec. 23, 1992

[51] Int. Cl.[5] ..... H01R 13/00

[52] U.S. Cl. ..... 439/160

[58] Field of Search ..... 439/152–160

[56] References Cited

U.S. PATENT DOCUMENTS

| | | | |
|---|---|---|---|
| 1,900,782 | 3/1933 | Way | 439/160 |
| 2,051,425 | 8/1936 | Schlums | 439/160 |
| 2,134,345 | 10/1938 | Sheeran | 439/160 |
| 3,609,547 | 9/1971 | Slusser | 439/160 |
| 4,898,540 | 2/1990 | Saito | 439/160 |
| 5,106,315 | 4/1992 | Billman et al. | 439/160 |
| 5,147,211 | 9/1992 | Tondreault et al. | 439/160 |

*Primary Examiner*—Joseph H. McGlynn
*Attorney, Agent, or Firm*—Ferdinand M. Romano; Charles C. Krawczyk; Daniel J. Staudt

[57] ABSTRACT

A mechanism structure for decoupling prong and socket type electrical connections, particularly for circuit board cards and their connections to receptacle-connectors in chassis-like housings. In one embodiment, the decoupling structure comprises a plate, a rotatable rod supported by the plate, an actuating lever attached to one end of the rod, and a cam attached along the rod. In application, the lever is pushed or pulled causing the cam to apply a force separating the circuit board from the receptacle connection so as to reduce or avoid torsional forces when disconnecting the board from the receptacle.

23 Claims, 5 Drawing Sheets

DECOUPLING TOOL MECHANISM FOR ELECTRICAL CONNECTORS

FIELD OF THE INVENTION

This invention relates to a mechanism for decoupling prongs from their respective sockets in an electrical connection, and in a preferred embodiment to a mechanism for decoupling a circuit board card from a receptacle connector.

BACKGROUND AND SUMMARY OF THE INVENTION

A circuit board card may comprise a single printed circuit board(PC) or multiple circuit boards connected in a module form sometimes having multiple output connectors. Insertion and removal of a circuit board card from a connecting socket is typically done by hand after these components have been manually connected. For a circuit board card housing one or several circuit boards, the edge of the card may contain a different connector for each board. The connector for each card comprises a plurality of conductive sockets or prongs. These sockets or prongs are mated to corresponding sockets or prongs in a receptacle which is usually mounted to a chassis-like housing. This receptacle which sometimes is called an edge connector, provides mechanical support for the circuit board card. The term "circuit board card" is used herein to refer to both individual circuit boards of the plug-in variety and modules of multiple circuit boards having one or more connectors mounted along an end portion.

In the past, to insert and remove a circuit board card, it has been necessary to firmly grip the circuit boards themselves. For insertion, sufficient force is applied to assure a reliable connection. Removal also required a firm grip and the application of pulling forces. However, the pulling forces often included a rotational force from having to free the card from the receptacle. Such removal might result in an undesirable twisting movement relative to the plane of the card. Such torsional forces can bend the circuit board cards and produce mechanical damage such as cracking on the corners or edges of a circuit board or card. This can lead to costly repair to the cards, the connector receptacle, and even the chassis-like housing in which these components are located.

Further, it is becoming more common for circuit board and card assemblies to be located in small physical spaces where insufficient room exists to generate the leverage necessary to properly decouple the card from the receptacle without causing damage to these components and to the system in which they are located.

Until now, the torsional problems and resulting wear or damage to components have been tolerated as necessary inescapable penalties associated with standard connector designs.

There is now provided a decoupling mechanism for reducing damage caused to cards comprising single or multiple circuit boards—and the respective connector-receptacles to which they are mated.

According to the invention, a prong and socket electrical connection is disengaged by positioning a rotatable arm about an interface of the prong and the socket, and the arm is rotated against the prong or the socket to force one away from the other.

There is also provided a mechanism for effecting this method wherein a tool for mechanically decoupling an electrical prong connection from an electrical socket connection comprises a rotatable arm for positioning about an interface of the prong connector and the socket connector, and a base for supporting the arm, wherein rotation of the arm pushes against both the base and one of the connectors causing a separation of the connectors from one another.

According to a preferred embodiment the rotatable arm of the decoupling mechanism comprises a rotatable rod with a cam shaped arm fixed at each end and a lever handle connected to one of the rod ends. The base comprises a plate that has an aperture for receiving mated prongs and sockets. The plate further comprises raised supports providing a restrictive path for the rod to travel along. According to a preferred method this mechanism is inserted about the interface of the card connector and the receptacle connector. To remove the card, the lever is pushed or pulled causing the rod to rotate within the raised supports. With this rotation the cam arms attached to the rod turn from a retracted position to push against the plate and the receptacle until the arms reach an extended position. The force exerted against the plate and the receptacle causes a separation of the card apart from the receptacle.

A guide can also be incorporated with the mechanism to facilitate decoupling of the card in a continuous linear direction apart from the receptacle with the card remaining parallel to the receptacle during disengagement. Four guide pins can be attached to the receptacle extending in the direction of the card, and four through-holes for the pins would be located in the plate. Movement of the pins through the holes guides decoupling of the card from the receptacle.

Embodiments for decoupling both a card comprising multiple circuit boards and for decoupling typical wall-plug connectors are also disclosed.

Of course cams have found a wide variety of applications in mechanical systems. Cams have even been used in conjunction with electrical connectors. See, for example, U.S. Pat. Nos. 3,997,747 and 4,261,631. As best understood, prior efforts to facilitate movement of electrical connectors with cam mechanisms has required both complex mechanical assemblies and modifications to otherwise standard connectors. Such specialized arrangements are often impractical in a cost-sensitive, high-volume manufacturing environment. Moreover, these known applications of cam mechanisms have not provided a solution to remove the torsional forces present during hand removal of a card. Further, the known systems are not useful in high density systems which place cards in small compact spaces.

DETAILED DESCRIPTION OF THE INVENTION

Figure 1A:
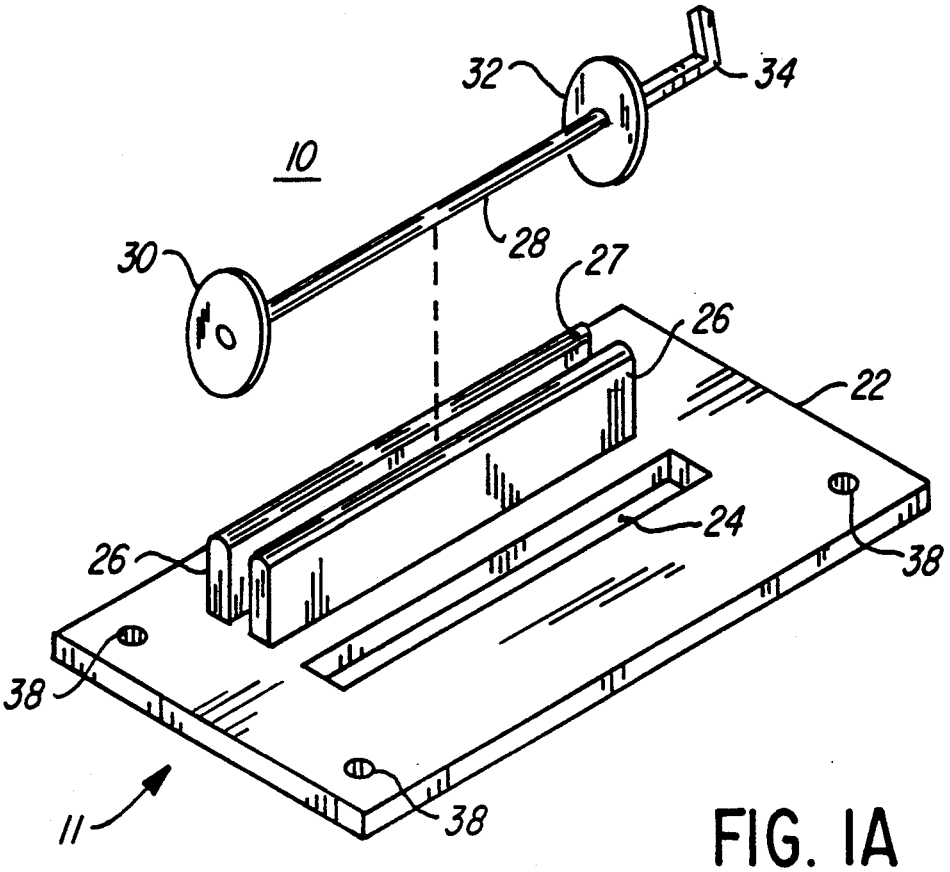
FIG. 1A illustrates, in exploded view, a decoupling tool according to the invention for use with a card comprising a single circuit board.
Figure 1B:
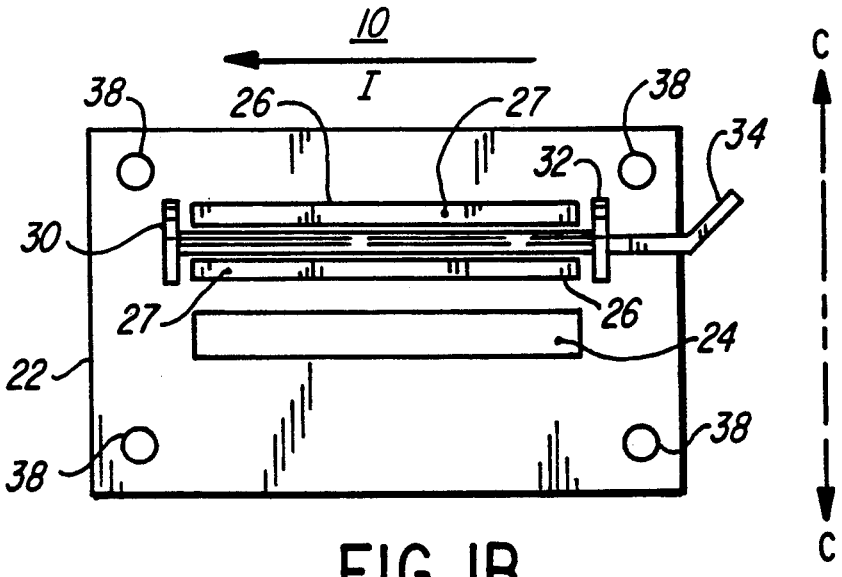
FIG. 1B illustrates in plan view the decoupling tool of FIG. 1A.

A first embodiment of the mechanism and method for operation is illustrated in FIGS. 1A through 1E. A tool mechanism 10 for decoupling mated prong and socket connectors of a circuit board card assembly is first illustrated in the break-away perspective view of FIG. 1A, generally including base 11 and rod 28. The mechanism is further illustrated in the plan view (relative to base 11) of FIG. 1B. As seen in FIGS. 1A and 1B, tool mechanism 10 comprises a base 11 which further comprises rectangular plate 22 with rectangular aperture/opening 24 through which either or both the board connector 12 and the receptacle connector 14 extend. Plate 22 further includes a pair of raised supports 26 for supporting rotatable rod 28. Both supports are positioned on one side of plate 22 adjacent opening 24. The length of each support 26 is less than the length of the plate. A pair of cam arms 30 and 32 in the form of oblong cam shapes are mounted near the ends of rod 28, and an activating lever handle 34 is mounted on one end of rod 28.

Figure 1C:
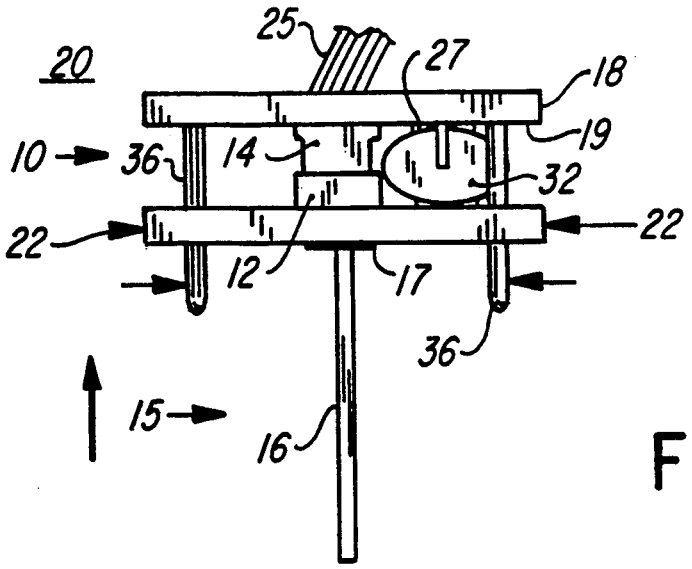
FIG. 1C provides a side view of an assembly including the decoupling tool taken in the direction of arrow I and along line C—C relative to FIG. 1B, with the tool in a retracted position.
Figure 1D:
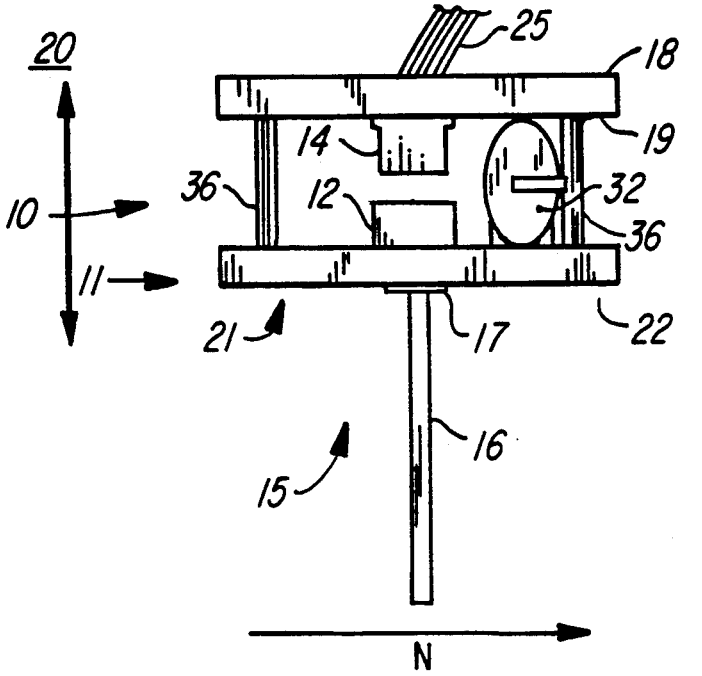
FIG. 1D illustrates the assembly of FIG. 1C with the decoupling tool operating in an extended position.
Figure 1E:
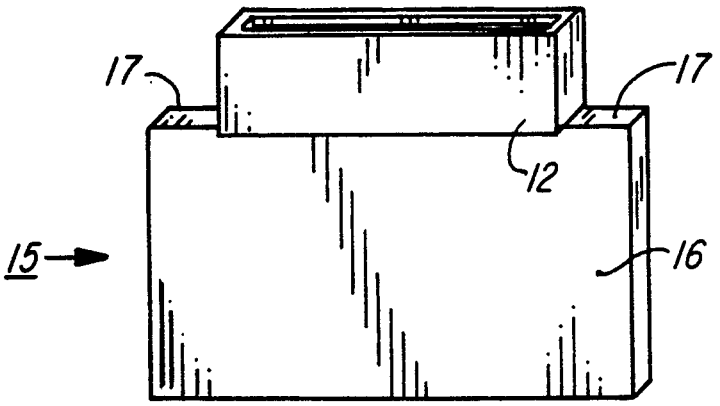
FIG. 1E illustrates a side view along arrow N of the circuit board card of FIGS. 1C and 1D illustrating shoulder portions and card connector.

FIG. 1C provides a side view of an assembly 20 including the decoupling tool 10 taken in the direction of arrow I and along line C—C relative to FIG. 1B with the tool operating in a retracted position. FIG. 1D illustrates the assembly of FIG. 1C with decoupling tool 10 operating in an extended position. FIG. 1E illustrates a side view along arrow N of the circuit board card 15 of FIGS. 1C and 1D. Circuit board card 15 comprises connector 12 and shoulder portions 17 of circuit board 16. In FIGS. 1C and 1D, lower planar surface 21 of plate 22 abuts against shoulder portions 17 of card 15, and the tops 27 of vertical supports 26 on the other side of plate 22 abuts against the lower planar surface 19 of receptacle 18. The aperture/opening 24 in the base 11 allows the board connector 12 and the receptacle connector 14 to mate with one another. In this particular embodiment, one of the connectors 12 is adapted to be connected to a printed circuit board card 15. The other connector 14 is adapted to be connected to receptacle 18 and cable assembly 25 that connects to other components in a Printed Circuit (PC) board system. As seen in FIGS. 1C and 1D, tool mechanism 10 is positioned between circuit board 16 and receptacle 18.

A preferred method of using decoupling tool mechanism 10 with a card containing a single circuit board will now be discussed. With reference to FIGS. 1C and 1D, rectangular plate 22 is positioned about the interface of the connectors between board 16 and receptacle 18 when these components are first interconnected. As seen in FIGS. 1A and 1B, plate 22 has a rectangular opening 24 for passing connectors 12 and 14 therethrough. Plate 22 comprises two vertical supports 26 which support rod 28 and cam shaped arms 30 and 32. The cam shaped arms 30 and 32 are moving from a retracted position (FIG. 1C) to an extended position (FIG. 1D) for decoupling card 15 from receptacle 18. Lever handle 34 is pushed or pulled to effect synchronous rotation of the cam arms 30 and 32 from their retracted position to their extended position and thereby apply forces to separate the card 15 apart from receptacle 18. During this separation, cam arms 30 and 32 push against both the plate 22 and the lower planar surface 19 of receptacle 18.

In accordance with the invention, a linear disconnect is accomplished by the rotation of the cam arms 30 and 32. Again, see FIGS. 1C and 1D. The cam arms 30 and 32 rotate to provide a separation force that allows both plate 22 and board 16 to separate apart from receptacle 18 in a linear manner thereby providing a linear disconnect between connectors 12 and 14. What is meant by linear disconnect is that the connectors 12 and 14 are separated in a straight line or in parallel planes so as to avoid any rotational or torsional movements in the decoupling process.

As an added feature for the invention and to facilitate decoupling the circuit board in a perpendicular direction, optional guide pins 36 and through-holes 38 for receiving guide pins 36 can be incorporated. FIGS. 1C and 1D illustrate use of guide pins 36, and FIGS. 1A and 1B illustrate through-holes 38. A preferred embodiment of this additional feature would include four guide pins 36 attached to receptacle 18 extending in the direction of the board 16, and four through-holes 38 formed in plate 22. The pins 36 would facilitate in guiding the decoupling of board 16 together and later apart from receptacle 18 as cam arms 30 and 32 are rotated to their extended position as shown in FIG. 1D. The pins and through-holes limit movement of the board 16 along a linear plane with receptical 18 so as to further avoid any rotational or torsional movements in the decoupling process.

Many alternative variations using this tool mechanism can be used. For example, with reference to FIGS. 1A through 1D, it is not necessary to mount the pins 36 in the receptacle 18. Alternatively, pins 36 can be mounted in rectangular plate 22 extending in the direction of receptacle 18 and through-holes 38 can be formed in receptacle 18. Pins 36 can be threaded metal screws with the heads missing, or any other useable component. Further, any number of pins and through-holes can be used. Additionally, it is not necessary to permanently fix plate 22 to circuit board 16, when the circuit board is initially mounted within receptacle 18. Thus, the decoupling tool is reusable when the need arises for replacement circuit boards. Additionally, lever handle 34 does not require activation directly by a human hand. Lever handle 34 can be electrically or mechanically activated. Furthermore, tool mechanism 10 can be used for decoupling any arrangement of interconnected prong and socket connectors.

Figure 2A:
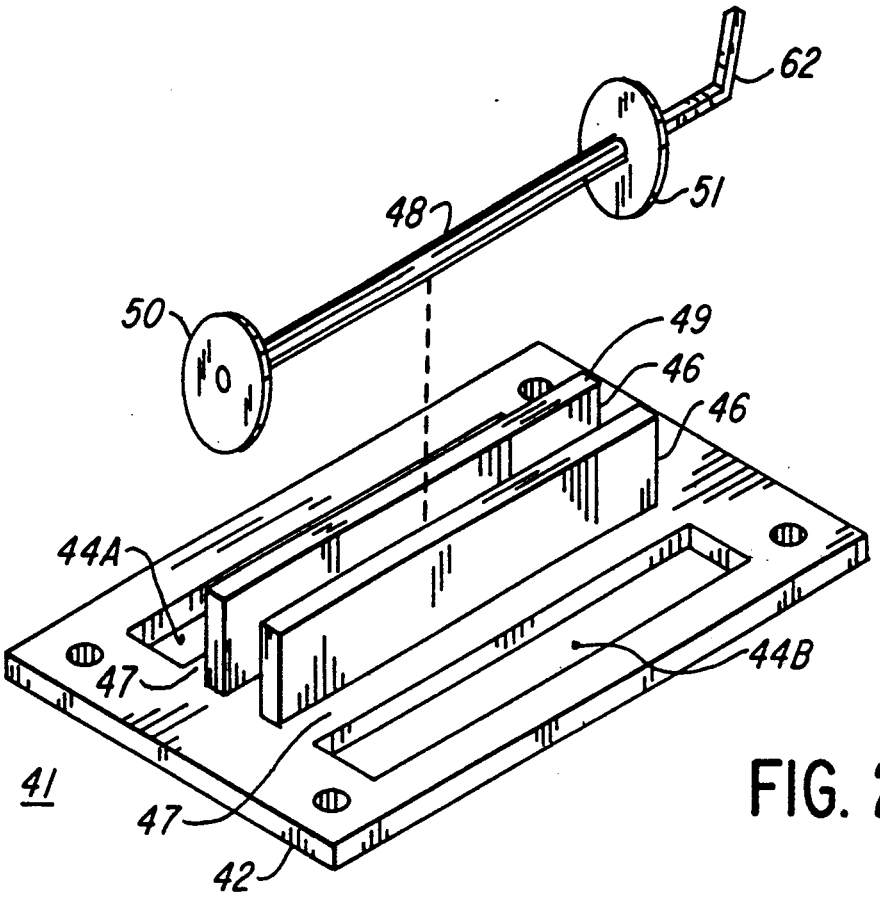
FIG. 2A illustrates, in exploded view, another decoupling tool according to the invention for use with a card comprising multicircuit boards.
Figure 2B:
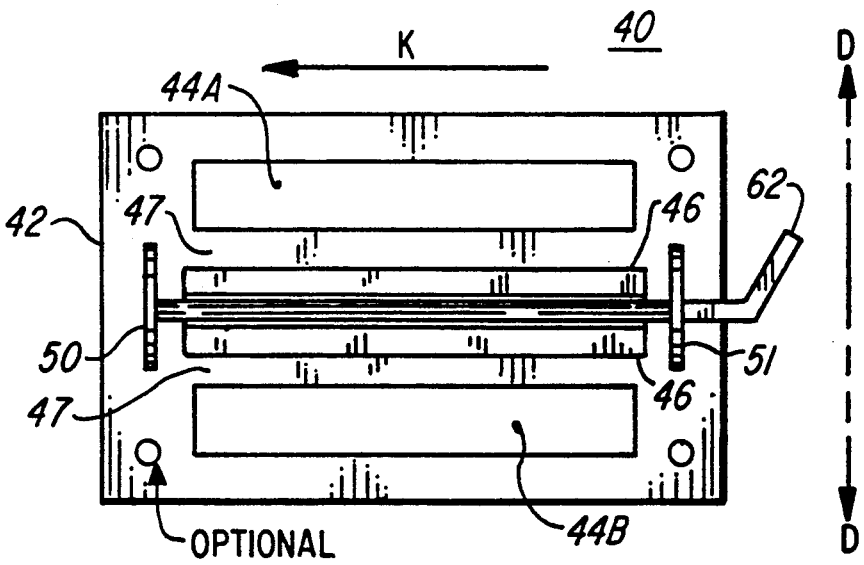
FIG. 2B illustrates in plan view, the decoupling tool of FIG. 2A with optional guide through-holes.

A second embodiment of the mechanism and method for operation is illustrated in FIGS. 2A through 2D. A tool mechanism 40 for decoupling mated prong and socket connectors of a multicircuit board card assembly is first illustrated in the break-away perspective view of FIG. 2A, generally including base 41 and rod 48. The mechanism is further illustrated in the plan view(relative to base 41) of FIG. 2B. As seen in FIGS. 2A and 2B, tool mechanism 40 comprises base 41 which further comprises rectangular plate 42 with two rectangular aperture/openings 44A and 44B adjacent to each other. Each opening is located on opposite sides of center portion 47 of plate 42 for passing connectors 52A, 52B, 54A and 54B therethrough. Plate 42 has a planar length and a planar width. Plate 42 further includes a pair of raised supports 46 for supporting rotatable rod 48. Both supports 46 are positioned on center portion 47 of plate 42. The length of each support 46 is less than the length of the plate 42. A pair of cam arms 50 and 51 in the form of oblong cam shapes are mounted near the ends of rod 48, and an activating lever handle 62 is mounted on one end of rod 48.

Figure 2C:
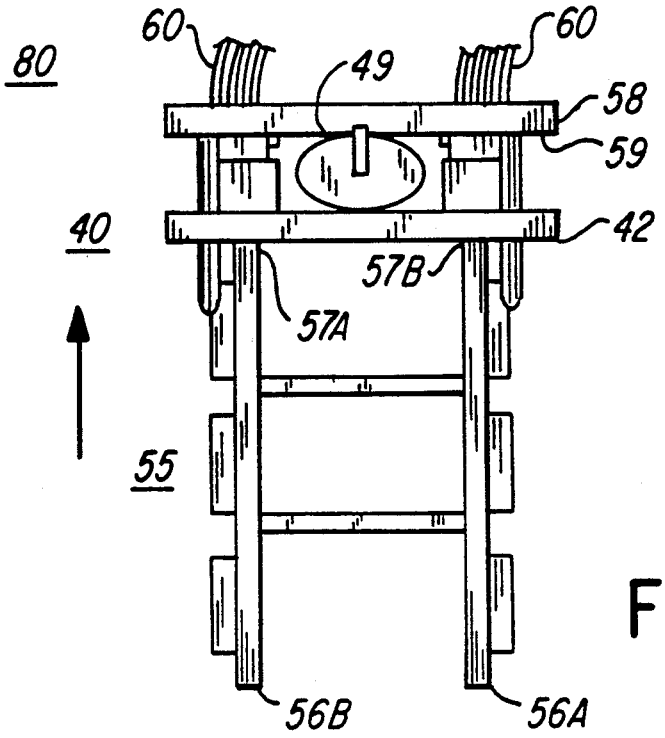
FIG. 2C provides a side view of an assembly including the decoupling tool taken in the direction of arrow K and along line D—D relative to FIG. 2B, with the tool in a retracted position.
Figure 2D:
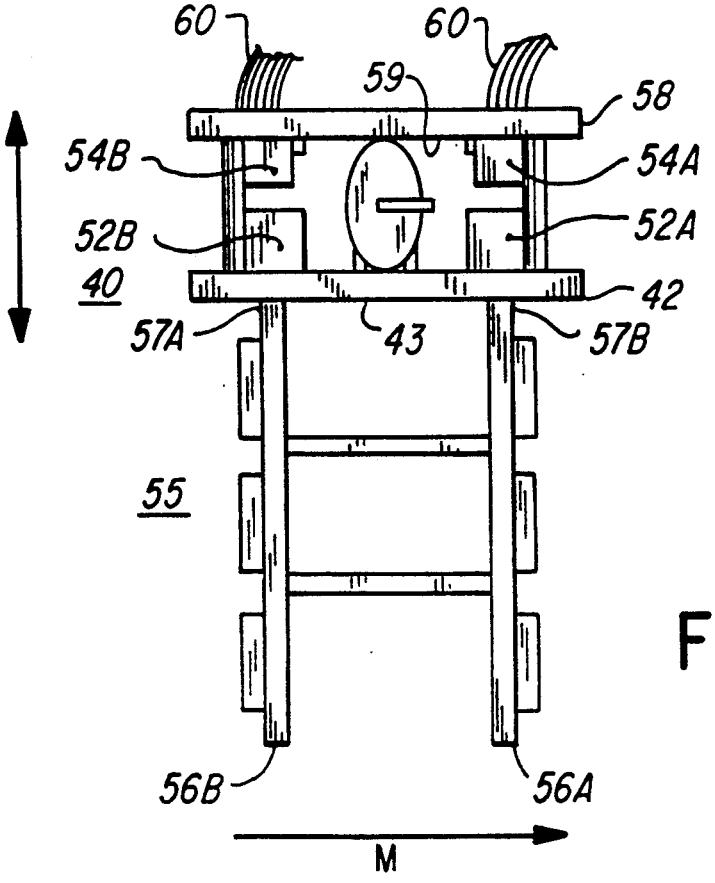
FIG. 2D illustrates the assembly of FIG. 2C with the decoupling tool operating in an extended position.
Figure 2E:
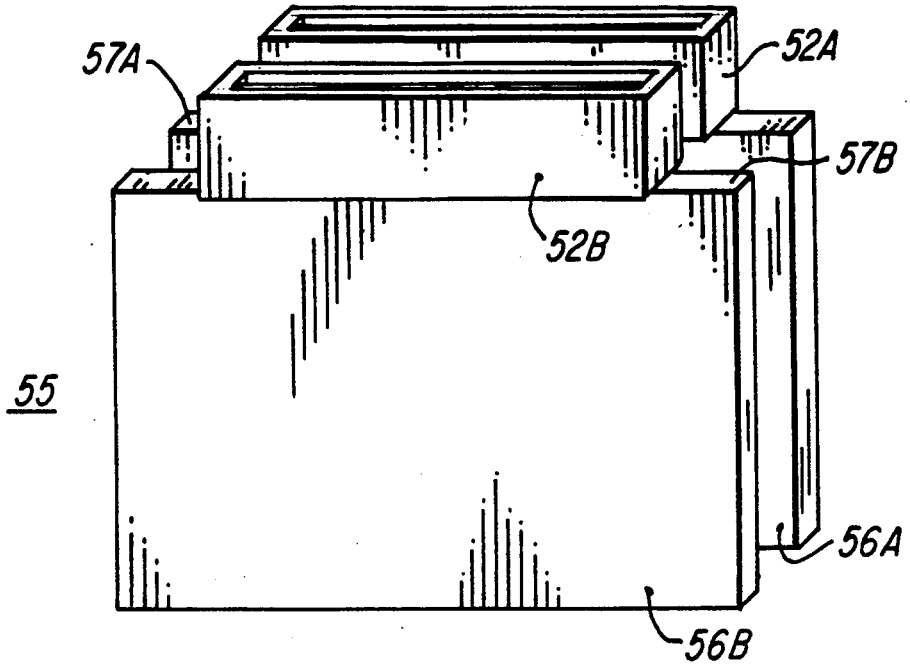
FIG. 2E illustrates a side view along arrow M of the multicircuit board card of FIGS. 2C and 2D illustrating shoulder portions and card connectors.

FIG. 2C provides a side view of a multicircuit card assembly 80 including decoupling tool 40 taken in the direction of arrow K and along line D-D relative to FIG. 2B with tool 40 operating in a retracted position. FIG. 2D illustrates the assembly of FIG. 2C with tool 40 operating in an extended position. FIG. 2E, illustrates a side view along arrow M of the multicircuit board card 55 of FIGS. 2C and 2D. Multicircuit board card 55 comprises connectors 52A, 52B, shoulder portions 57A, 57B and two parallel connected circuit boards 56A, 56B. In FIGS. 2C and 2D, the lower planar surface 43 of plate 42 abuts against shoulder portions 57A, 57B of card 55, and the tops 49 of vertical supports 46 on the other side of plate 42 abuts against the lower planar surface 59 of receptacle 58. The aperture/openings 44A, 44B in plate 42 allows board connectors 52A, 52B and receptacle connectors 54A, 54B to mate with each another. In this particular embodiment, connectors 52A, 52B are adapted to be connected to multicircuit board card 55. The other connectors 54A, 54B are adapted to be connected to receptacle 58 and cable assembly 60 that connects to other components in a Printed Circuit (PC) board system. Tool mechanism 40 is positioned about the interface of the mated connectors of circuit board card 55 and receptacle 58.

A preferred method of using the decoupling tool with a card containing two circuit boards will now be discussed. With reference to FIGS. 2C and 2D, rectangular plate 42 is positioned about the interface of the connectors between card 55 and receptacle 58 when these components are first interconnected. As seen in FIGS. 2A and 2B, plate 42 has rectangular openings 44A, 44B for passing connectors 52A, 52B, 54A, and 54B therethrough. Plate 42 comprises two vertical supports 46 which support rod 48 and cam shaped arms 50 and 51. The cam shaped arms 50 and 51 are moving from a retracted position(FIG. 2C) to an extended position(-FIG. 2D) for decoupling card 55 apart from receptacle 58. Lever handle 62 is pushed or pulled to effect synchronous rotation of cam arms 50 and 51 from their retracted position to their extended position and thereby apply forces to separate card 55 apart from receptacle 58. During this separation, cam arms 50 and 51 push against both the plate 42 and the lower planar surface 59 of receptacle 58. 2D.

In accordance with the invention, a linear disconnect is accomplished by the rotation of cam arms 50 and 51. Again, see FIGS. 2C and 2D. Cam arms 50 and 51 rotate to provide a separation force that allows both plate 42 and card 55 to separate apart from receptacle 58 in a linear manner thereby providing a linear disconnect between connectors 52A, 52B and connectors 54A, 54B. What is meant by linear disconnect is that connectors 52A, 52B and connectors 54A, 54B are separated in a straight line or in parallel planes so as to avoid any rotational or torsional movements in the decoupling process.

As an added feature for the invention and to facilitate decoupling circuit boards 56A and 56B in a perpendicular direction, optional guide pins and through-holes as described in the embodiment depicted in FIGS. 1A through 1D can be incorporated herein. Guide pins and through-holes have not been depicted here for purposes of simplifying the illustrations.

Along with the alternative variations referenced with the embodiment depicted in FIGS. 1A through 1D, other variations are applicable as well. Although only two circuit boards 56A and 56B are seen in FIGS. 2C and 2D, any number of circuit boards can be decoupled by modifying tool mechanism 40 accordingly.

The embodiment illustrated in FIGS. 2A through 2E has been used in conjunction with testing equipment, such as gamma cell radiation testing equipment. This equipment is used to irradiate integrated circuits and other electronic components in order to test their tolerances for gamma radiation. The nature of the system is that the devices under test are mounted in sockets which in turn are mounted on printed circuit board cards which in turn are mounted to connector-receptacles. These components are placed in extremely compact volumes for lowering into the test chamber of the gamma cell. The connector-receptacles make electrical contact to the circuit board cards and hence the devices under test, and in turn are wired through a ribbon cable and certain shielded cables to a variety of test systems and power supplies located outside the gamma cell system. The devices in the sample chamber are mechanically lowered into the radiation chamber of the gamma cell. Electrical data testing and exercising the devices under test conditions proceeds either while the components are immersed in the radiation field or when they are mechanically removed while still in the sample chamber to another region of the system. The testing often proceeds sequentially with a period of radiation under electrical bias of the devices under test followed by a period of comprehensive or partial testing of the devices in a non-radiative environment. The sequence is repeated until a desired cumulative radiation has impinged on the devices being tested. Since the sample chamber is extremely restrictive, there is very little room for effective decoupling of the circuit board cards from their connector-receptacles for purposes of disassembling the experiment, replacing the devices under test and so forth. With the decoupling mechanism described above, virtually no extra space is required in the sample chamber assembly. With this mechanism, decoupling is greatly facilitated and the circuit board card and its related components are not damaged.

The decoupling mechanisms by their design, provides several beneficial features. First, the lever in combination with the cam provides a large mechanical advantage to decouple circuit board cards from receptacles with relatively little effort. Secondly, the mechanisms remove the cards in a perpendicular direction to the line of contact between the cards and their receptacles. This eliminates wear, tear and the possibility of torsional overstress to the cards, the receptacles and their respective connectors. Third, the point of application of the decoupling force is at the lever and not at the receptacle. The mechanism can be configured to place the lever in a physical position where there is sufficient space for movement to allow the decoupling to occur. Fourth, actuating the lever requires less space than was previously needed for removing a circuit board card. Thus, with the mechanisms, circuit board cards comprising plural circuit boards can be more tightly packed together requiring less space. Fifth, the mechanisms can be applied to cards comprising double sided printed circuit boards or single sided printed circuit boards with their respective receptacles. Sixth, the decoupling mechanisms are reusable since they are not permanently affixed. Thus, the cost of a decoupler mechanism over the long term would be negligible compared to the replacement cost of damaged circuit board cards, their boards, receptacles and their respective connectors.

Based on the above disclosure, various modifications and alternative embodiments will be apparent. Embodiments for decoupling typical two and three prong wall plugs connected to wall-receptacle outlets such as those of household appliances can also be created with the above disclosure. Typically, the wall-plug includes a casing and prongs extending therefrom for mateable connection to socket connectors of a wall-receptacle outlet, which includes a protective wall plate. Rotatable cam arms can be attached to rotatable rods on both sides of the plug casing. Normal grasping of the wall-plug casing can push dual levers on each side of the plug casing and effect rotation of the cam arms against the surface of the wall plate to quickly and easily decouple the plug prongs from the socket connectors of the wall-receptacle outlet. Such an application would reduce the tendency of using the power cord wire which is coupled to the wall-plug casing as leverage to pull the wall-plug from its outlet. Accordingly, the invention is only to be limited by the claims which follow:

I claim:

1. A mechanical assembly comprising;

(a) a circuit board card having at least one circuit board with at least one connector and a shoulder portion about the connector, the card adapted to be mateable at an interface to at least one connector of a receptacle;

(b) a separate plate neither mechanically attached to nor molded from the card and the receptacle, the plate positioned about the interface of the card connector and the receptacle connector, having an upper surface portion adapted to abut against the receptacle and a lower surface to abut against the shoulder portion of the card;

(c) a rod, having first and second ends, rotatably supported by the upper surface of the plate;

(d) a rotatable arm attached to the rod between the first and second ends; and (e) a lever handle connected to one end of the rod for providing a rotational force to the arm to urge the board and the receptacle apart.

2. The assembly of claim 1, wherein the upper surface portion of the plate includes two raised supports for supporting the rod.

3. The assembly of claim 1 wherein the rotatable arm comprises at least one oblong cam shape.

4. The assembly of claim 1 wherein the mechanism further includes a guide to facilitate aligned movement of the card relative to the receptacle.

5. The assembly of claim 4 wherein the guide comprises pins attached to the receptacle extending in the direction of the plate and holes formed int he plate for receiving the pins.

6. A method for mechanically disengaging a prong and socket electrical connection comprising the steps of:

positioning a rotatable arm at an interface between the prong and the socket; and rotating the arm so as to engage the prong and the socket to force the prong and the socket apart, and supporting the rotatable arm by two vertical supports attached to a separate plate, wherein the plate is neither mechanically attached to nor molded from the prong and the socket.

7. The method of claim 6 wherein the arm comprises at least one oblong cam shape.

8. The method of claim 6 further comprises the step of guiding the prong and the socket apart from one another using a guide to avoid rotational or torsional movements.

9. A method for mechanically disengaging mated connectors of a circuit board card and a receptacle comprising the steps of:

providing a lever attached to one end of a rod and at least one rotatable arm attached between the lever and the other end of the rod;

supporting the rod by a plate which is neither mechanically attached to nor molded from the connectors, said plate being formed with at least one opening for allowing the connectors to be mated therethrough, and a support extending from one side of the plate and adjacent the opening for rotatably supporting the rod;

positioning the plate between the receptacle and the card so that their connectors can mate through the opening; and actuating the lever to cause the arm to rotate and separate the card and the receptacle.

10. The method of claim 9 wherein the rod comprises at least one oblong cam shape.

11. The method of claim 9 further comprising the step of guiding each connector apart from one another using a guide to avoid rotational or torsional movements.

12. The method of claim 11 wherein the guide includes attaching pins to one connector extending in the direction of the other connector and forming holes in the other connector for receiving the pins.

13. A tool for mechanically decoupling an electrical prong from an electrical socket comprising:

(a) an arm rotatably positioned between the prong and the socket in a manner so that the arm is rotatable to engage the prong and the socket;

(b) a lever to effect rotation of the arm to engage the prong and the socket in order to apply a force to separate the prong and the socket apart;

(c) at least one rotatable rod connected to both the arm and the lever; and (d) a plate for rotatably supporting the rod, wherein the plate is neither mechanically attached to nor molded from the prong and the socket.

14. The tool of claim 13 wherein the tool further includes a guide to facilitate aligned movement of the prong relative to the socket.

15. A tool for mechanically decoupling an electrical prong connector from an electrical socket connector comprising a rotatable arm for positioning about an interface connection of one connector and an other connector;

a base for supporting the arm positioned between the arm and one connector, wherein rotating the arm causes the arm to engage both the base and the other connector causing a vertical separation of the connectors from one another; and wherein the base includes a plate for rotatably supporting the rotatable arm, wherein the plate is neither mechanically attached to nor molded from the connectors.

16. The tool of claim 15 wherein the rotatable arm comprises:

a rod having first and second ends and at least one oblong cam shape attached thereto.

17. The tool of claim 15 wherein the tool further includes:

a lever attached to one end of the arm.

18. The tool of claim 15 wherein the plate further includes:

two raised supports for rotatably supporting the arm.

19. The tool of claim 15 wherein the tool further includes:

a prong plug as the one connector; and a wall-plug receptical as the other connector.

20. The tool of claim 15 wherein the tool further includes:

a guide for facilitating aligned movement of the one connector away from the other connector.

21. The tool of claim 20 wherein the guide further includes:

four pins attached to the one connector; and four holes formed on the plate for receiving the pins, to facilitate aligned movement of the card away from the one connector as the cam arms are rotated to an extended position.

22. An electrical connector arrangement including a cam mechanism comprising:

a first electrical connector adapted to abut against one side of a first plate and extend through the first plate so that contacts of the connector are accessible from the other side of the first plate, wherein the first late is neither mechanically attached to nor molded from the first electrical connector;

a second electrical connector secured to a second plate and adapted to mate with the first connector; and cam means positioned between the first and the second connectors having a connect position for enabling the first and second connectors to mate, and is rotatable from the connect position in a direction to urge the first and the second plates apart for disconnecting the connectors.

23. The mechanism of claim 22 further including a guide to facilitate aligned movement of the first electrical connector relative to the second electrical connector.

* * * * *